US006192215B1

(12) United States Patent
Wang

(10) Patent No.: US 6,192,215 B1
(45) Date of Patent: Feb. 20, 2001

(54) INTERACTIVE AND ANIMATED MINI-THEATER AND METHOD OF USE

(76) Inventor: Mai Wang, 7146 Golden Gate Dr., San Jose, CA (US) 95129

( * ) Notice: Under 35 U.S.C. 154(b), the term of this patent shall be extended for 0 days.

(21) Appl. No.: 09/528,970

(22) Filed: Mar. 20, 2000

Related U.S. Application Data

(63) Continuation-in-part of application No. 09/178,363, filed on Oct. 23, 1998, now Pat. No. 6,039,625.

(51) Int. Cl.[7] ..... G09B 5/00

(52) U.S. Cl. ..... 434/307 R; 434/365; 446/83; 40/414

(58) Field of Search ..... 434/307 R–309, 434/365; 446/14, 175, 83, 304, 82, 84, 352, 354, 358, 367, 299, 484, 302; 40/414, 418, 419, 420, 442; 472/57, 60, 61, 75, 76; 185/37, DIG. 1

(56) References Cited

U.S. PATENT DOCUMENTS 1,628,628 * 5/1927 Hunt ..... 40/419
2,100,486 * 11/1937 Lohr ..... 446/83
5,013,276 * 5/1991 Garfinkel ..... 446/14
5,040,319 * 8/1991 Wang et al. ..... 40/414
5,085,609 * 2/1992 Haberle ..... 446/83
5,468,171 * 11/1995 Taylor ..... 446/82
5,503,560 * 4/1996 Stentiford ..... 434/167
6,039,625 * 3/2000 Wang ..... 446/83

FOREIGN PATENT DOCUMENTS

2227183A * 7/1990 (GB) .

* cited by examiner

*Primary Examiner*—Joe H. Cheng
(74) *Attorney, Agent, or Firm*—Gene Scott-Patent Law & Venture Group

(57) ABSTRACT

A mechanical puppet show apparatus provides a base unit supporting on its upper surface (stage) one or more mechanical puppets. The puppets are interconnected with a circuit for motion actuation in accordance with a stage play that is programmed into a memory device and controlled by a digital control unit. Manual, remote control and verbal signals may be received for interactive action of the puppets with the audience. A method for use of materials downloaded by packet data transfer from the Internet may be employed in programming.

14 Claims, 4 Drawing Sheets

INTERACTIVE AND ANIMATED MINI-THEATER AND METHOD OF USE

This application is a continuation-in-part of U.S. patent application Ser. No. 09/178,363, filed on Oct. 23, 1998, now U.S. Pat. No. 6,039,625, the contents of which are incorporated herein by reference.

BACKGROUND OF THE INVENTION

1. Field of the Invention

This invention relates generally to a miniature theatre apparatus, and more particularly to such a theatre with capability for interacting with members of the audience.

2. Description of Related Art

The following art defines the present state of this field: Stentiford, U.S. Pat. No. 5,503,560 describes a speech synthesizer produces prompts in the voice of a native speaker of a language to be learned to which the student replies or imitates. A phrase recognizer employs keyword recognition to generate from the student's prompted response an original speech template spoken by the student. Thereafter, interactive dialogue takes place. The student's progress in that dialogue is monitored by measuring the deviation of the student's current speech from his original speech template. When this deviation is sufficiently large so that the recognizer no longer recognizes what the student is saying, the system retrains and updates the student's speech template. In another embodiment, the system includes a display which shows the native speaker's mouth shape while the words to be imitated are spoken by the speech synthesizer. Also provided are a video pick-up and analyzer for analyzing the shapes of the student's mouth to give the student visual feedback.

Wang et al., U.S. Pat. No. 5,040,319 describes a toy band assembly including a stage assembly, a plurality of movable toy figures, such as toy frog figures, a plurality of toy musical instruments, a sound pick-up unit, a stage lights assembly, power supply, a power supply switch, and integrated circuit, a front transmission mechanism, a front reciprocating mechanism, a rear transmission mechanism, and a rear reciprocating mechanism. When the power supply switch is switched on, light bulbs in a stage lights assembly start to flash and the sound pick-up unit picks up sound signals from the surroundings and directs electric signals to the integrated circuit. The integrated circuit electrically connects the power supply means to a front and a rear motor when sufficient electrical signal is received. The front and rear motors rotate and translate their rotations to the front and rear transmission mechanisms and to the front and rear reciprocating mechanisms. The plurality of toy figures is mechanically connected to the front and rear reciprocating mechanism and correspondingly moves left and right, up and down. The mouths and heads of the plurality of toy figures are capable of movement, thus giving an impression that the toy figures are performing before an audience.

Haberle, U.S. Pat. No. 5,085,609 describes a puppet theater with a playback device for sounds provided during a theatrical performance has an electrically actuatable display for each puppet to be used. Control signals are recorded on the sound medium of the playback device, and include display controls to trigger the displays to cue the puppeteer during the performance as to which puppet is to be used at a given time in the script. The control signals of the playback device can also include automatic commands for unwinding a backdrop, and signals for controlling the illumination of colored lamps which light the stage.

Taylor, U.S. Pat. No. 5,468,171 describes a portable puppet theater system including: a vertically disposed first front section having a rectangular configuration having an enlarged opening therethrough; a vertically disposed second rear section in a rectangular configuration having a periphery generally corresponding to that of the first section; a pair of side bars pivotable coupling the sides of the front section and rear section, the side bars also being pivotable at the centers thereof, to allow the front and rear sections to be moved toward each other for a collapsed orientation and away from each other for an operative orientation; a pelmet positioned across the upper edge of the opening with side curtains at the sides of the opening movable between a closed position in contact with each other and an open position allowing viewing through the opening; a plurality of lights located adjacent the upper edge of the opening; a tape player located adjacent to the lower edge of the opening; speakers mounted on the front face of the front section beneath the opening; a microphone operatively coupled to the speakers; a control panel on the back face of the front section for controlling the lights and the microphone along with a tape player; and a porous see-through backdrop constituting the central extent of the rear sections.

Yasuta et al, GB 2227183A provides an apparatus including at least one article having movable parts (e.g. eyes, mouth, limbs), a recording medium bearing at least sound information relating to the article, and means for playing back the medium and, as a result, causing movement of the parts and reproduction of the sound information. The medium may be a video tape having two audio tracks, and having video information reproduced on screen. Part of the screen may display information which is detected by a sensor and used to control the program of movement and sound.

Lohr, U.S. Pat. No. 2,100,486 relates to toys, more particularly to dancing figure toys. The primary object of the invention is to generally improve dancing figure toys. Amore particular object resides in the provision of such a toy in which the figure will be cased to move not only vertically to simulate dancing, but also from side to side. In accordance with a further feature and object of the invention, the vibration and movements of the toys are given an irregularity such as to simulate tap dancing. Other objects of the invention concern the general organization and arrangement of the toy, and are to simulate a small stage with an appropriate back drop; to conceal the motor works and operating mechanism behind the drop; and to support and control the movement of the figure toy by means of a support arm which extends in a relatively inconspicuous manner from the toy rearwardly through and opening in the back drop.

Hunt, U.S. Pat. No. 1,628,628 relates to mechanical miniature theatricals. The object of the invention is a combination of a miniature theatrical stage with figures disposed thereabout to represent animate beings, and mechanical devices co-operating with special constructions of the individual figures whereby the miniature figures are caused to perform ordinary actions of animate beings in a lifelike manner, the whole being coordinated to cause a predetermined relation of the actions of one or more figures to those of other figures, with the result of causing the production on a small scale of a theatrical play or the like, involving actions by a number of individuals.

The prior art teaches the use of mechanical objects on a miniature stage where the objects are mechanically animated and respond to music or other audio prompts. However, the prior art does not teach that such a staged program may be interactive with a member(s) of the audience by accepting verbal commands, interpreting the commands through voice recognition techniques and respond accordingly. The present invention fulfills these needs and provides further related advantages as described in the following summary.

SUMMARY OF THE INVENTION

The present invention teaches certain benefits in construction and use which give rise to the objectives described below.

The present invention provides a mechanical stage with puppets, an amusement program capable of driving a presentation with puppet action, a means by which verbal audience commands may be accepted in order to determine actions of the puppets including their verbal reactions and the capability of receiving programming from the Internet.

A primary objective of the present invention is to provide an interactive puppet theatre having advantages not taught by the prior art.

Another objective is to provide such a theatre having certain specific characters.

A further objective is to provide such a theatre having an acoustic pickup and word recognition capability so that audience response may be used to direct the action of the puppets.

A still further objective is to provide such a theatre capable of receiving data packets downloaded from the Internet for programming of the theatre.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
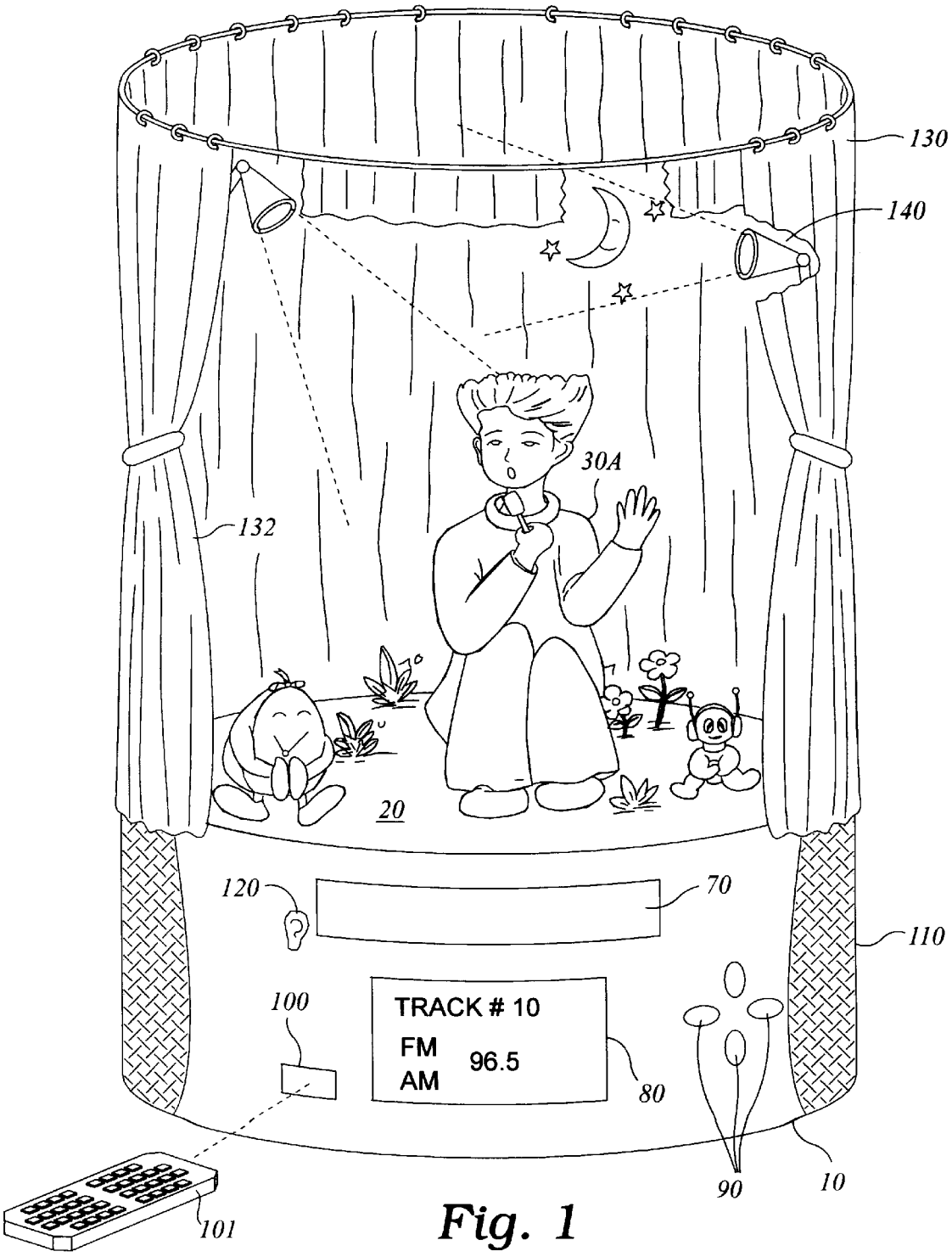
FIG. 1 is a front elevational view of the preferred embodiment of the present invention.

The above described drawing figures illustrate the invention, an animated theatre apparatus comprising a theatre base 10 providing an upwardly facing base surface 20 for use as a theatre stage for supporting at least one animated theater character or puppet 30A or 30B or 30C thereon, a motion producing means 40, preferably small servo motors, vibrators, solenoids or other electrically actuated physical motion devices, engaged with the at least one animated theatre character 30A, B and C for enabling the animated character to move in a manner characteristic thereof through the use of a servo-control circuit 42 of any common type. An electric circuit means 50 such as a printed circuit board assembly, provides a program storage means 60, such as an integrated circuit solid state memory device. A mass storage means 70 such as a compact disk or CD-ROM is provided in the base 10, along with a display means 80 such as a liquid crystal display (LCD). A manual input control means 90 such as electrical actuation buttons, touch sense pads or other common controls may be used to control the theater. Other elements of the invention include remote input receiving means 100 such as an infrared radio wave receiving means, or other similar devices, an audio output means 10 such as one or more loudspeakers, an audio input means 120 such as a microphone, and a central processing unit means (CPU) 135 and, as is well known in the current art, a word recognition device comprising a microphone, A/D converter, comparitor, digitized word storage inventory, and control program, all as part of the circuit 50. Further details of such a system is unnecessary to present here since the technology is well known and commercially available. The present invention is able to provide true interactive realism between the puppets 30A, B, C and the audience with a remarkably small word inventory. For instance, by simply being able to recognize the verbal "yes" and "no" as uttered by a member of the audience, it is possible for the puppet program to interact to a large extent with the audience.

As an example, we can assume that the puppet program provides for an intelligent discourse between two of the puppets. A point may be programmed to appear in the puppet play whereby one of the puppets must make an important decision relative to the other, i.e., to accept a marriage proposal, for instance. An important novel dimension may be interjected into the play by bringing the audience into the decision making. One puppet may ask the audience, through the audio means as a stage whisper, whether or not to marry. The program script may then take a unique turn of events if the audience input is in the negative rather then in the positive. Such interactive interjection into the plot provides a very unique, novel and valuable improvement over the state of the art in the field of the present invention. The theatre apparatus further comprises a theatre program 62 within the program storage means 60, whereby the theatre program 62 is enabled for directing electrical motion signals to the motion producing means 40 for moving the at least one animated theatre character 30A or 30B or 30C, and for directing electrical signals including electrical illuminating current to the display means 80, and the audio output means 110 corresponding to information stored in the mass storage means 70 in response to electrical signals received by the manual 90 and the remote control receiving means 100 and the audio input means 120 so as to produce an interactive animated program. A remote control device 101, as shown in FIG. 1, nay be used.

The theatre apparatus preferably further comprises a curtain assembly 130 engaged with and extending upwardly from the theatre base 10, the curtain assembly 130 enabled for positioning a stage curtain 132 in an open state, as shown in FIG. 1, for viewing the base surface 20 and the at least one animated character 30A–C, and alternately in a closed state, not shown, for inhibiting such viewing. Such enablement may be made by any of a wide variety of well known mechanical actuation devices.

Figure 2:
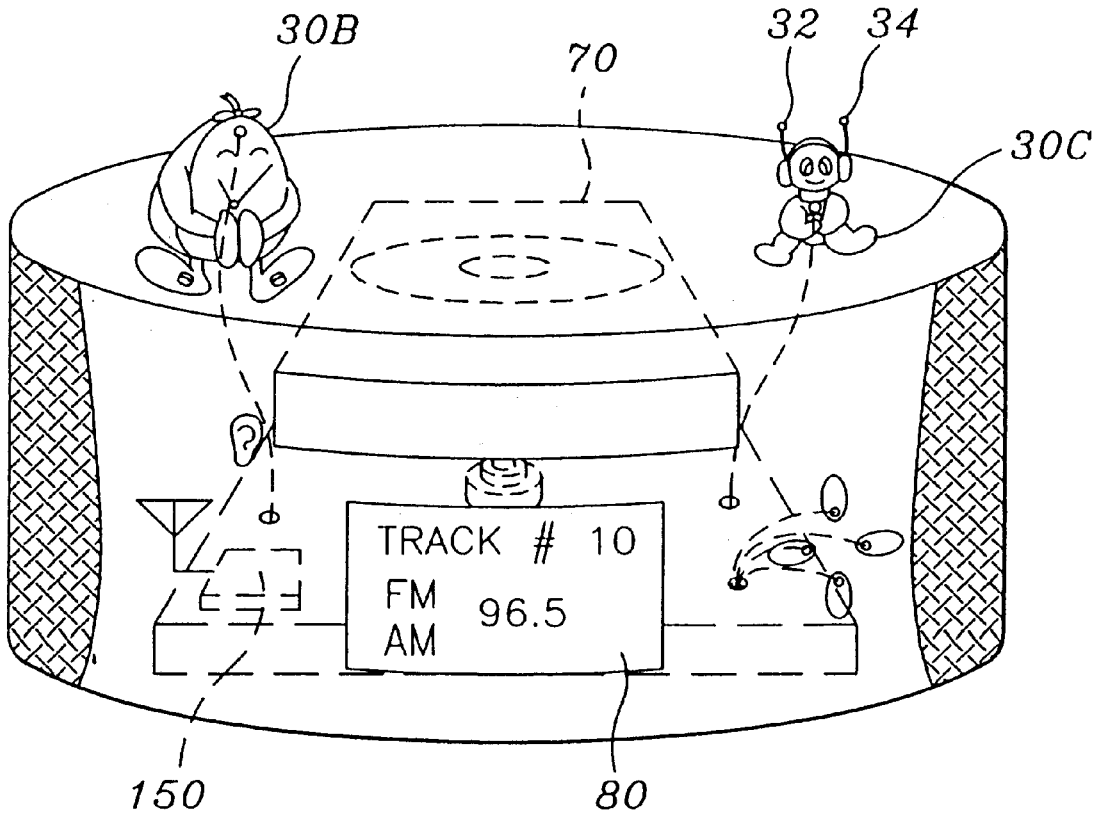
FIG. 2 is a view of a base portion of FIG. 1 showing a means for actuation of puppets of the invention.
Figure 3:
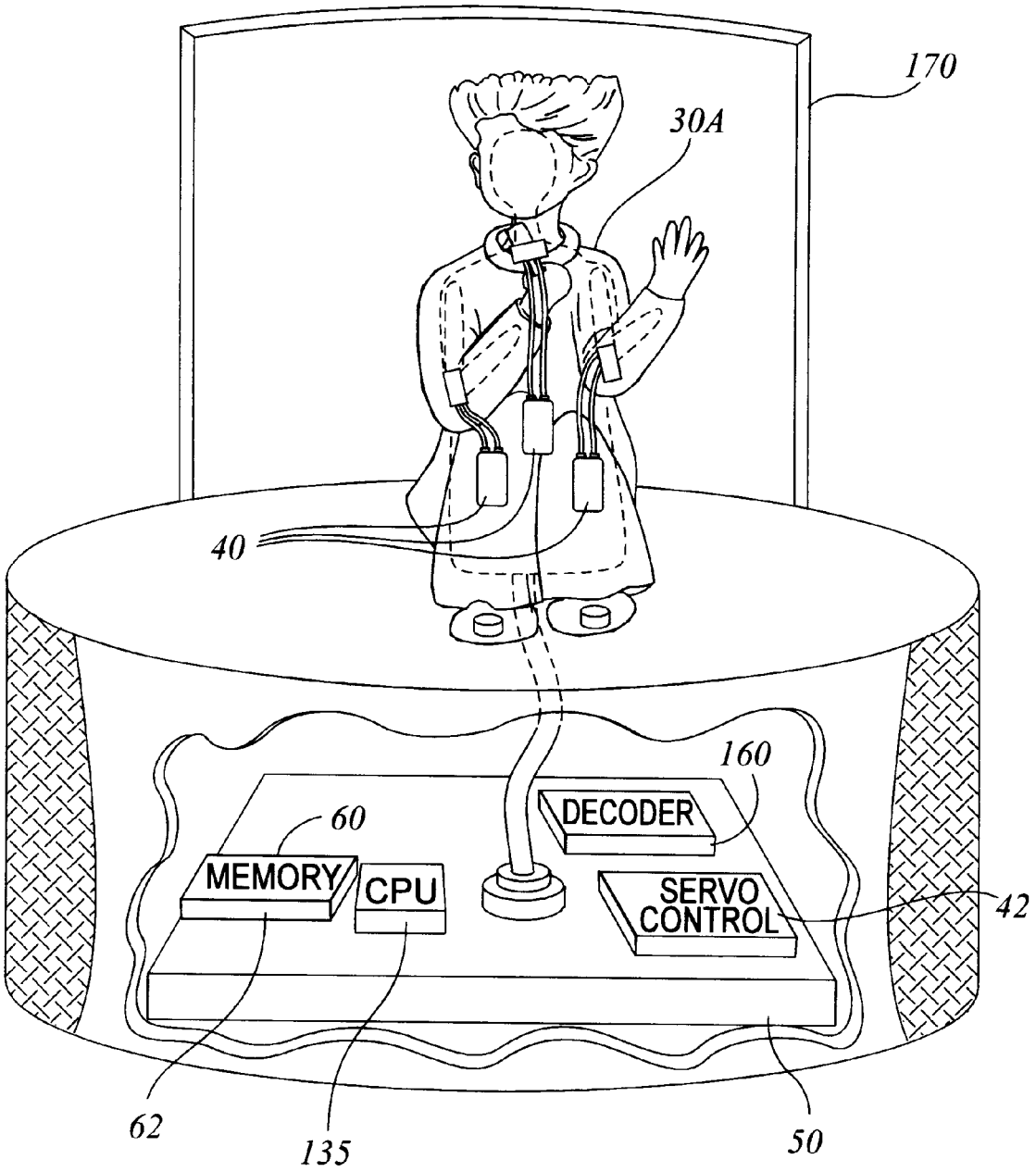
FIG. 3 is a view of a base portion of FIG. 1 showing a breakaway of a puppet of the invention and a means for actuation of same.

Preferably, the at least one animated character 30A, 30B or 30C, resembles a recognizable character and another resembles a clock, the clock providing movable clock hands as shown by the FIG. 30B in FIGS. 1 and 2.

Preferably, the invention further includes a lighting means 140, such as miniature spot lights positioned for illuminating the at least one animated character 30A or 30B, or 30C, etc., the lighting means 140 interconnected with the circuit means 50 for actuation in accordance with the theatre program as controlled by the word recognition device as previously described.

Preferably, the invention includes a radio wave receiving means 150 interconnected with the circuit means 50 for actuation in accordance with the theatre program and for displaying the station on the display means 80. Preferably the radio wave receiving means 150 is controlled by at least one animated character providing means for controlling tuning 32 and volume 34 functions of the radio wave receiving means 150, in the preferred embodiment by rotating the antennae of the FIG. 30C. Alternative radio adjustment controls may be employed on the character.

The mass storage device 70 (CD-ROM) may be programmed to control the actions and speech of the puppets as well as background music and sounds through the CPU 135 so that a library of different CD-ROM's are able to enable a wide variety of plays through the employment of just a few fixed characters. The mass storage means 70, is enabled for playing a standard music CD so that the invention may be employed as a music CD player, a radio receiver or a puppet theatre, thereby enabling a variety of entertainment approaches.

Figure 4:
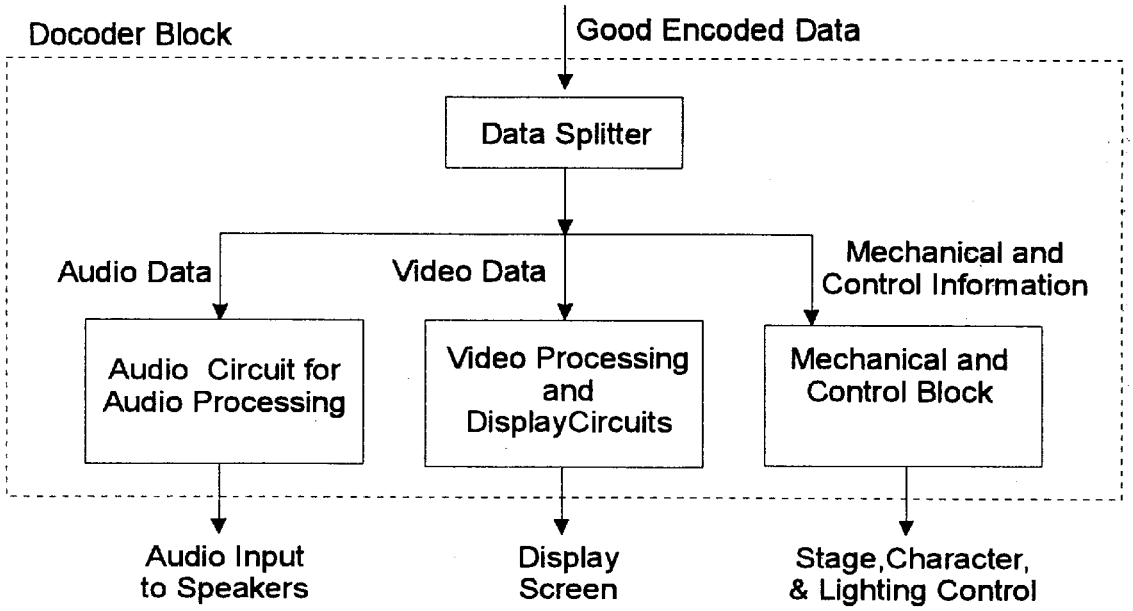
FIG. 4 is a diagram defining a decoder block of the invention.
Figure 5:
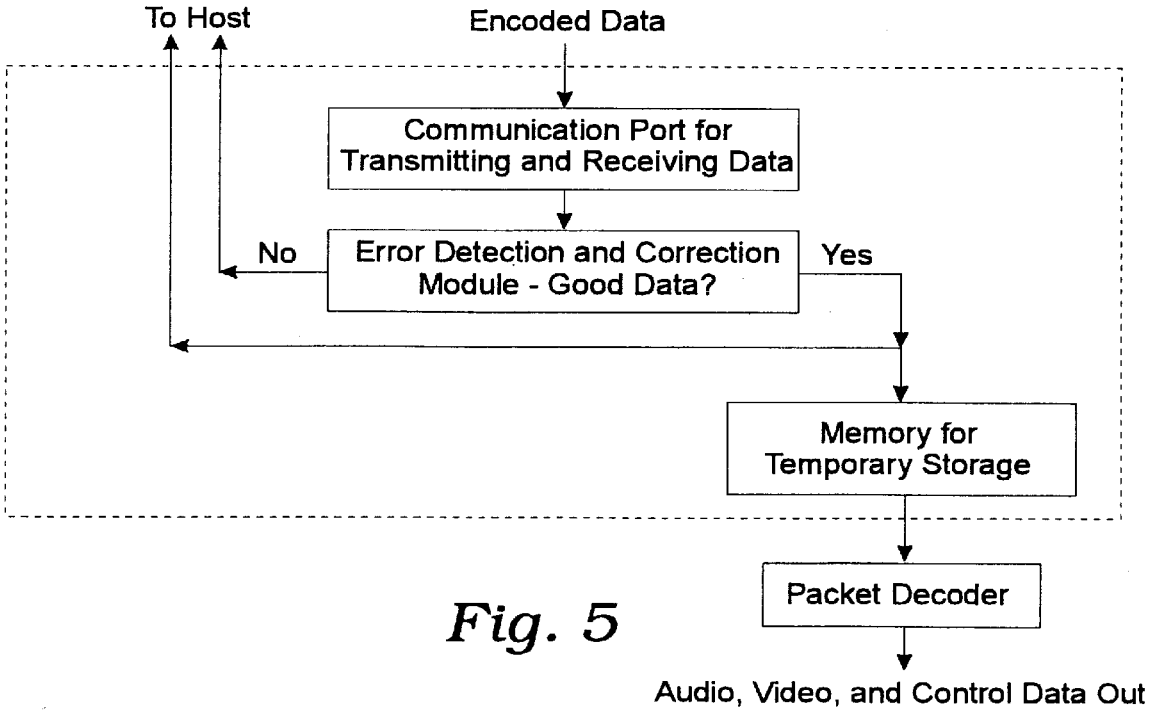
FIG. 5 is a diagram defining a portion of the signal flow of the invention.

The invention method produces an animated theatre presentation comprising the steps of providing the miniature theatre described above and having at least two animated theater characters 30A–C and a motion producing means 40 for enabling character movement, directing display signals and audio signals corresponding to stored information in response to input signals so as to produce an interactive animated program. Such input may be provided in a variety of ways including, well known manual input devices such as keyboard and computer pointing devices (not shown). Data packets (signals) may be received from a remote source, wherein such data packets preferably contain audio data, video data, control signal data, synchronization data, header data, and error detection-correction data or a subset of these. Audio and video data are those sound and picture signals that will be used by the theater performance. Control signal data represent the control signals that direct theatre action including sound and video display. Synchronization data are signals that identify where each data packet starts and ends. Header data are signals that identify exactly what is included in each packet, such as the presence and duration of audio and video signals, encryption format, and so on. Error detection and correction data are used to detect errors and to recover fiom such errors. The contents and the enablement by such contents in thc packets is in accordance with well known technical approaches to such transmission of information and data signals. In general, the packets are passed through an error detection and correction module 160 (decoder block shown in FIG. 4 schematically and which also functions as a communications module) which produces an acknowledgement signal transmitted to the host so as to request replacement of bad data, if any. This is shown in FIG. 5. The data packets are decoded so as to separate the audio data, video data; control signal data, synchronization data, header data and error detection-correction data into their respective signal portions and each is then conducted to its respective end use device, as for instance, an audio output device such as a speaker, a video output device such as a monitor or display screen 170, a central processor unit (CPU) for establishing control of a software program so as to produce character motion and lighting control. Some of the packet information may be stored in memory devices for later or future use and some may be used currently. The data packets may be downloaded from the Internet either manually or automatically, and if the later, the interfacing is accomplished according to a preset schedule at a preset URL address. If the data packets are downloaded manually, it is accomplished using a keyboard (not shown) to provide an address and give instructions as to what is to be received and to send the "go ahead" commend. If the data packets are downloaded automatically, it is accomplished via a previously set-up protocol whereby certain information are sent from a remote source and received at a previously selected time.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A miniature animated theatre apparatus comprising:

a miniature theatre base providing an upwardly facing base surface for use as a theatre stage for supporting at least two animated theater characters thereon;

motion producing means engaged with at least one of the animated theatre characters for enabling movement characteristic thereof;

circuit means providing program storage means, mass storage means, display means, manual input control means, remote input control means, audio input means, audio output means, and word recognition device; and a theatre program within the program storage means, the theatre program enabled for directing motion signals to the motion producing means for moving the characters and for directing signals to the display means, and the audio output means corresponding to audio information stored in the mass storage means in response to signals received by the manual and the remote control means and the audio input means, through the word recognition device, so as to produce an interactive animated program;

wherein the remote input control means providing a communication module adapted for receiving data packets from a remote source, wherein such data packets contain at least one of: audio data, video data, mechanical control signal data, synchronization control signal data, header information, and error detection-correction information.

2. The apparatus of claim 1 further comprising a curtain assembly engaged with and extending upwardly from the theatre base, the curtain assembly enabled for positioning a stage curtain in an open state for viewing the base surface and the at least one animated character, and alternately in a closed state for inhibiting such viewing.

3. The apparatus of claim 1 wherein the at least one animated character resembles a creature.

4. The apparatus of claim 1 wherein the at least one animated character resembles a clock, the clock providing movable clock hands.

5. The apparatus of claim 1 further including a lighting means positioned for illuminating the at least one animated character, the lighting means interconnected with the circuit means for actuation in accordance with the theatre program.

6. The apparatus of claim 1 further including a radio wave receiving means interconnected with the circuit means for actuation in accordance with the theatre program and for displaying the station on the display means.

7. The apparatus of claim 6 further including at least one animated character providing means for controlling tuning and volume functions of the radio wave receiving means.

8. The apparatus of claim 1 further comprising a manual input signal device including at least one of: a keyboard and a computer pointing device.

9. The apparatus of claim 1 further comprising a display screen adapted for displaying the video data.

10. A method for producing an animated theatre presentation comprising the steps of:

a) providing a miniature theatre having at least two animated theater characters and a motion producing means for enabling character movement;

b) directing display signals and audio signals corresponding to stored information in response to input signals so as to produce an interactive animated program;

c) receiving data packets from a remote source, wherein such data packets contain at least one of: audio data, video data, control signal data, synchronization data, header data, and error detection-correction data;

d) decoding the data packets so as to separate the audio data, video data; control signal data, synchronization data, header data and error detection-correction data;

e) excluding faulty and erroneous data in the data packets;

f) conducting the good audio data to an audio output device;

g) conducting the good video data to a video output device; and h) conducting the good control signal data so as to produce character motion and lighting control.

11. The method of claim 10 further providing the step of manually downloading the data packets from the Internet.

12. The method of claim 10 further comprising the step of automatically downloading the data packets from the Internet at preset times.

13. The method of claim 10 further comprising the step of receiving a manual input signal from at least one of: a keyboard and a computer pointing device.

14. The method of claim 10 further comprising the step of displaying the video data on a display screen.

* * * * *